US006398332B1

(12) United States Patent
Silverbrook et al.

(10) Patent No.: US 6,398,332 B1
(45) Date of Patent: Jun. 4, 2002

(54) CONTROLLING THE TIMING OF PRINTHEAD NOZZLE FIRING

(75) Inventors: Kia Silverbrook, Balmain; Simon Robert Walmsley, Epping, both of (AU)

(73) Assignee: Silverbrook Research Pty Ltd, Balmain ( * ) Notice: Subject to any disclaimer, the term of this patent is extended or adjusted under 35 U.S.C. 154(b) by 34 days.

(21) Appl. No.: 09/607,990

(22) Filed: Jun. 30, 2000

(51) Int. Cl.[7] ..... B41J 29/38; B41J 2/21; B41J 2/04

(52) U.S. Cl. ..... 347/12; 347/43; 347/54

(58) Field of Search ..... 347/12, 13, 58, 347/59, 43

(56) References Cited

U.S. PATENT DOCUMENTS 5,265,315 A * 11/1993 Hoisington et al. ..... 29/25.35
5,604,527 A * 2/1997 Ng et al. ..... 347/240
5,754,193 A 5/1998 Elhatem ..... 347/13
5,867,183 A 2/1999 Cornell ..... 347/13
6,102,510 A * 8/2000 Kikuta et al. ..... 347/9
6,139,125 A * 10/2000 Otsuka et al. ..... 347/11
6,149,259 A * 11/2000 Otsuka et al. ..... 347/12
6,243,111 B1 * 1/2001 Imananka et al. ..... 347/13

FOREIGN PATENT DOCUMENTS

EP 390202 10/1990 ..... B41J/2/05
EP 842777 A 5/1998 ..... B41J/2/05

* cited by examiner

*Primary Examiner*—John Barlow
*Assistant Examiner*—Alfred E. Dudding

(57) ABSTRACT

The firing of nozzles on rows for respective ink channels in a multi-segment printhead, each segment being a printhead chip, is effected by loading print data to respective channel shift registers on respective segments, transferring all print data in parallel to nozzle enable bits provided one per nozzle and firing the nozzles in respective channels in time independent manner using separate timing generators in each channel. Nozzles are fired by a pulse train with a programmed profile. The pulse profile is determined by programmed bits loaded to a timing generator. The programmed bits exist in tables loaded to the printhead, one for each channel. Ideally the printhead nozzle rows are in offset pairs for each channel and firing of the offset pairs is by out of phase pulse trains.

18 Claims, 7 Drawing Sheets

CONTROLLING THE TIMING OF PRINTHEAD NOZZLE FIRING

FIELD OF THE INVENTION

The invention relates to a method of controlling the timing of the firing of printhead nozzles and to a printhead chip and printer operating according to the method.

BACKGROUND OF THE INVENTION

Various methods, systems and apparatus relating to the present invention are disclosed in the following co-pending United States patent applications filed by the applicant or assignee of the present invention on May 23, 2000: NPA001US, NPA002US, NPA003US, NPA004US, NPA005US, NPA006US, NPA007US, NPA008US, NPA009US, NPA010US, NPA012US, NPA016US, NPA017US, NPA018US, NPA019US, NPA020US, NPA021US, NPA030US, NPA035US, NPA048US, NPA050US, NPA051US, NPA052US, NPA075US, NPB001US, NPB002US, NPK002US, NPK003US, NPK004US, NPK005US, NPK007US, NPM001US, NPM002US, NPM003US, NPM004US, NPN001US, NPN002US, NPN003US, NPP001US, NPP002US, NPP003US, NPP005US, NPP006US, NPP007US, NPP008US, NPP016US, NPP017US, NPP018US, NPP019US, NPS001US, NPS003US, NPS020US, NPT001US, NPT002US, NPT003US, NPT004US, NPX001US, NPX003US, NPX008US, NPX011US, NPX014US, NPX016US, NPX020US, NPX022US, IJ52US, IJM52US, MJ10US, MJ11US, MJ12US, MJ13US, MJ14US, MJ15US, MJ34US, MJ47US, MJ52US, MJ58US, MJ62US, MJ63US, PAK04US, PAK05US, PAK06US, PAK07US, PAK08US, PEC01US, PEC02US, PEC03US.

In addition, various methods, systems and apparatus relating to the present invention are disclosed in the following co-pending United States patent applications filed simultaneously by the applicant or assignee of the present invention: PEC04US, PEC06US, PEC07US.

The disclosures of these co-pending applications are incorporated herein by cross-reference. Each application is temporarily identified by its docket number. This will be replaced by the corresponding USSN when available.

Of particular note are co-pending U.S. patent applications MJ62US, IJ52US, IJM52US, MJ63US, MJ58US, which describe a microelectomechanical drop on demand printhead hereafter referred to as a Memjet printhead.

The above Memjet printhead is a multi-segment printhead that is developed from printhead segments that are capable of producing, for example, 1600 dpi bi-level dots of liquid ink across the full width of a page. Dots are easily produced in isolation, allowing dispersed-dot dithering to be exploited to its fullest. Color planes might be printed in perfect registration, allowing ideal dot-on-dot printing. The printhead enables high-speed printing using microelectromechanical ink drop technology.

Co-pending U.S. patent applications PEC01US, PEC02US, PEC03US, PEC04US, PEC06US, and PEC07US describe a print engine/controller suited to driving the above referenced page wide multi-segment printhead.

A multi-segment printhead of the above kind may field 1280 nozzles. Firing all the nozzles together would consume too much power. It could give rise to problems in terms of ink refill and nozzle interference.

Firing logic controls the firing of nozzles. Normally the timing of firing of nozzles in a printhead is controlled externally. It is desirable to reduce the complexity that arises in external printhead controllers as a consequence of this. Further, at the printhead, each of the colored inks used has different characteristics in terms of viscosity, heat profile etc. Firing pulses should therefore be generated independently for each color.

SUMMARY OF THE INVENTION

The invention resides in control of the firing of nozzles in a printhead, the nozzles being on rows for respective ink channels in the printhead. Print data is loaded to respective channel shift registers for respective channels. All the print data is transferred to nozzle enable bits provided one per nozzle and the nozzles in respective channels are fired in time independent manner using separate timing generators in each channel.

Moving the timing mechanisms onto the printhead helps reduce complexity. In addition, as each color channel is given its own timer, a given color's firing pattern can be started at any time. It need not be an exact number of dot-lines from another. It is possible to print dot on dot via appropriate staggering of the start timing in respective channels although this regime is not adopted in the preferred embodiment described below.

Normally the widths and profiles of firing pulses are generated externally to the printhead. In the preferred embodiment below the pulse widths of electrical pulses by which to fire the nozzles is programmable.

With the above in mind, the nozzles are fired by an electrical pulse. The profile of the pulse is programmed to suit the ink at the nozzle. Ideally the printhead includes ink nozzles in multiple rows, successive rows of nozzles defining respective ink channels and an electrical pulse train fires the nozzles. Pulse profiles in the pulse train are programmed to suit the ink in respective channels. Ideally, programmed bits loaded to a timing generator adjust the pulse profile. Ideally the programmed bits exist in tables loaded to the printhead, one for each channel, the tables being programmed via the printhead serial interface. The nozzle rows are preferably in offset pairs for each channel and firing of the offset pairs is effected by out of phase pulse trains.

With the above multi-segment printhead (Memjet) technology (outlined in the referred-to documents) the microelectromechanical process is added to a CMOS process by which to construct the printheads. The consequent printhead is a new type. The marriage with CMOS technology allows inclusion of logic in the printhead chip. It is an ideal place to locate timing circuitry for firing of nozzles.

In a particular form the invention resides in a method of controlling a printhead including nozzle rows, successive rows of nozzles defining respective ink channels wherein the nozzles in respective channels are similarly grouped and groups are fired successively. Ideally respective rows of nozzles are organized in repeated pods of nozzles along the length of each row of nozzles, the nozzles in a pod being fired one after the other along the row; successive pods of respective channels are linked as a chromapod wherein the one after the other firing of nozzles in each channel is in step along the row of nozzles in the respective pods; and blocks of chromapods are operated as a firegroup, the firegroups firing together. The nozzles within a single segment are grouped physically to reduce ink supply complexity and wiring complexity. They are also grouped logically to minimize power consumption and to enable a variety of printing speeds, thereby allowing speed/power consumption tradeoffs to be made in different product configurations.

DETAILED DESCRIPTION OF THE PREFERRED EMBODIMENTS

Figure 1:
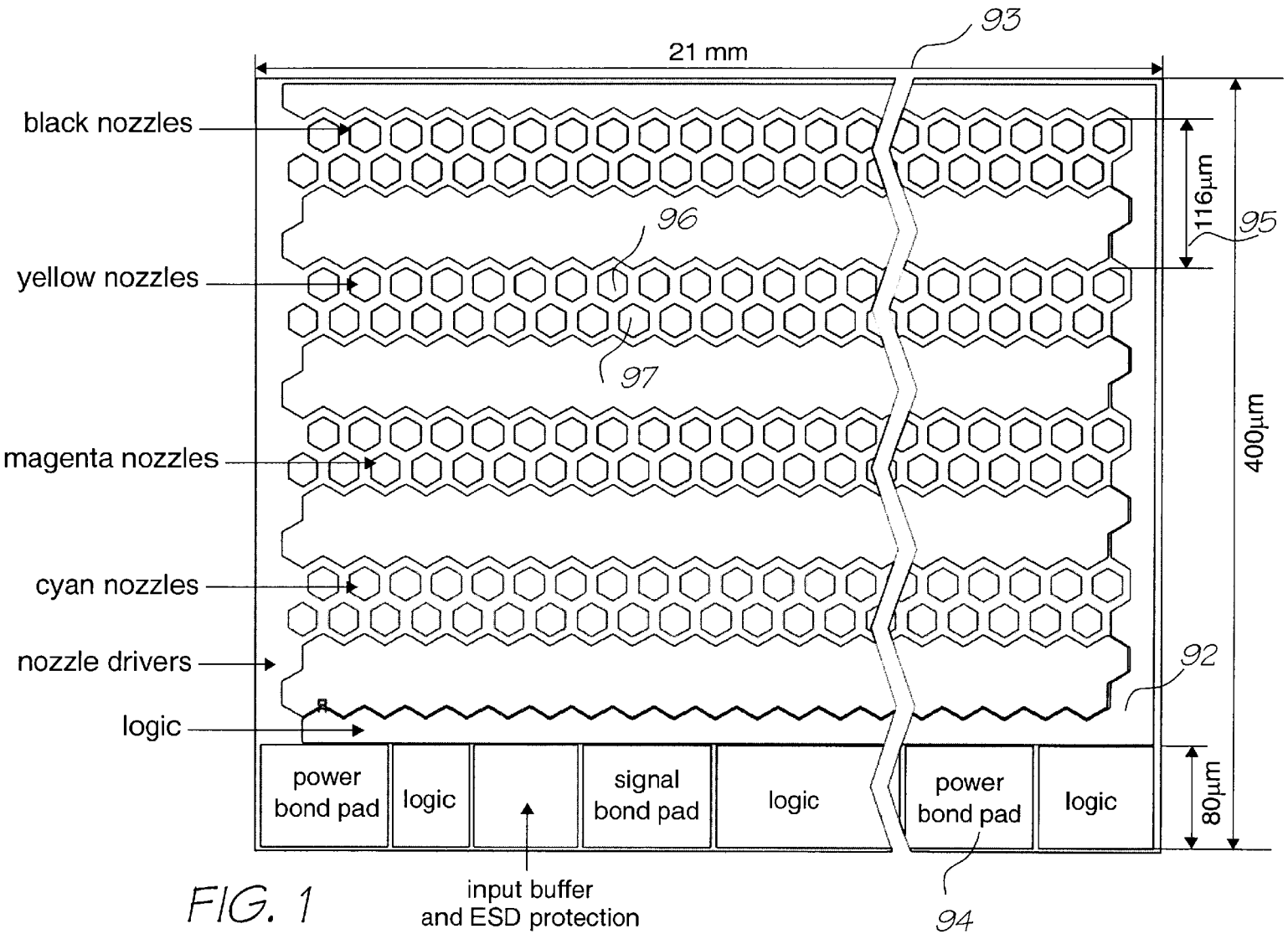
FIG. 1 illustrates an arrangement of nozzles in a four-color printhead segment.

In FIG. 1 is seen the arrangement of nozzles in a four color printhead segment 92. A single printhead segment in a multi-segment printhead is typically 21 mm in length (93). The width of the segment is typically 80 μm for bond pads 94 and other logic, plus 116 μm (95) per color contained within the segment (in high speed applications an extra color channel may be required for fixative). Table 1 lists the printhead widths for the most common printhead types.

TABLE 1

Printhead segment widths based on number of colors

| #Colors | Color channels | Application | Segment width (μm) |
|---|---|---|---|
| 3 | CMY | Photographic | 484 |
| 4 | CMYK | Desktop printers | 600 |
| 5 | CMYK-IR | Netpage-enabled | 716 |
| 6 | CMYK-IR-F | High-speed Netpage enabled | 832 |

The composition of each 116 μm color band is ideally two rows of 640 nozzles, such as 96,97 for the yellow nozzles, for a total of 1280 nozzles per color. The number of colors determines the total number of nozzles in the segment. Table 2 lists some examples.

TABLE 2

Example nozzle counts

| #Colors | Example application | Total nozzles per segment |
|---|---|---|
| 1 | K | 1280 |
| 3 | CMY | 3840 |
| 4 | CMYK | 5120 |
| 6 | CMYK-IR-F | 7680 |

Figure 2:
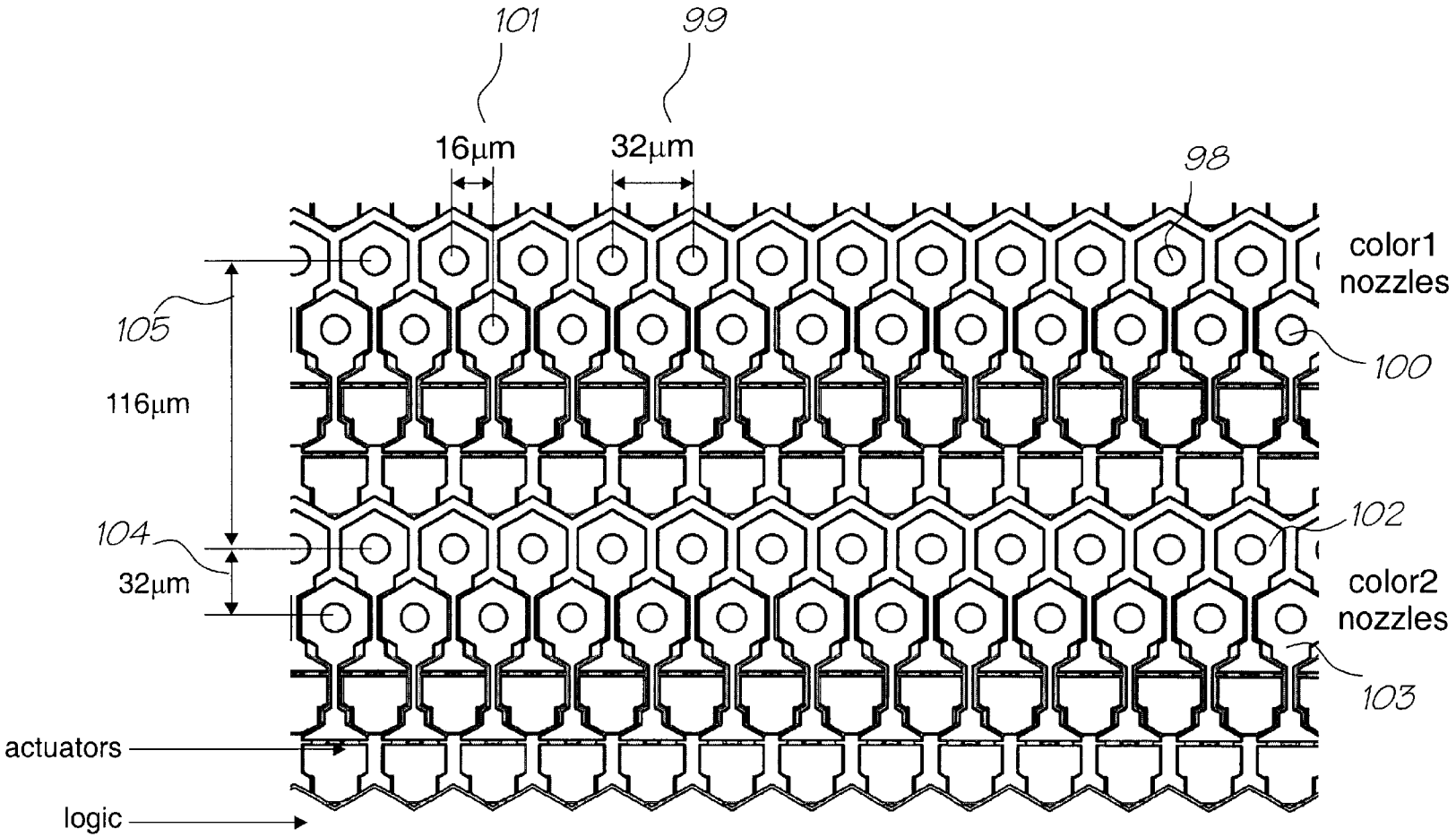
FIG. 2 is a closer view of the nozzle region of the printhead of FIG. 1.

In FIG. 2 is seen a more detailed view of the nozzle region of the printhead of FIG. 1. Within a single row of nozzles 98, the nozzles are typically separated by 32 μm (99), while the two rows 98,100 are offset by 16 μm (101). The distance from one 1600 dpi dot to the next is actually 15.875 μm, but the segment will be placed at 7.167 degrees relative to the paper such that the horizontal distance between printed dots is 15.875 μm. This nozzle placement gives rise to interleaved nozzles for a single line of pixels—one row prints even dots and the other prints odd dots.

Looking at the nozzles in FIG. 2, it is clear that if both rows 102,103 of cyan nozzles were to fire simultaneously, the ink fired would end up on different physical lines of the paper: the odd dots would end up on one line, and the even dots would end up on another. Likewise, the dots printed by the magenta nozzles 98,100 would end up on a completely different set of two dot lines. The physical distances between nozzles is therefore of critical importance in terms of ensuring that the combination of colored inks fired by the different nozzles ends up in the correct dot position on the page as the paper passes under the printhead. The distance between the two rows of the same color is 32 μm (104), or 2 dot rows. This means that odd and even dots of the same color are printed two dot rows apart. The distance between rows of one color and the next color is 116 μm (105). Note that this gives 7.25 dot lines which is not an integral number of dot lines. The printing of one color compared to the next is therefore staggered in time to accommodate the time taken for the paper to move a complete dot. If nozzles for one color's dot line are fired at time T, then nozzles for the corresponding dots in the next color must be fired at time T+7.25 dot-lines. The relationships between the various rows of nozzles can be generalized by defining two variables:

$D_1$=distance between the two rows of the same color in dot-lines=2

$D_2$=distance between the same row of nozzles between two colors=7.25

We can now say that if the first row of nozzles is row L, then row 1 of color C is dot-line:

$L-(C-1)D_2$ and row 2 of color C is dot-line:

$L-(C-1)D_2-D_1$

The relationship is shown in Table 3 for an example 6-color printhead. Note that one of the 6 colors is fixative which must be applied first.

TABLE 3

Relationship between different rows of nozzles

| Color | Sense | Dot Line | When $D_1 = 2$, $D_2 = 7.25$ |
|---|---|---|---|
| 1 (fixative) | row 1 | L | L |
| | row 2 | $L-D_1$ | L-2 |
| 2 (black) | row 1 | $L-D_2$ | L-7.25 |
| | row 2 | $L-D_2-D_1$ | L-9.25 |
| 3 (yellow) | row 1 | $L-2D_2$ | L-14.5 |
| | row 2 | $L-2D_2-D_1$ | L-16.5 |
| 4 (magenta) | row 1 | $L-3D_2$ | L-21.75 |
| | row 2 | $L-3D_2-D_1$ | L-23.75 |
| 5 (cyan) | row 1 | $L-4D_2$ | L-29 |
| | row 2 | $L-4D_2-D_1$ | L-31 |
| 6 (infrared) | row 1 | $L-5D_2$ | L-36.25 |
| | row 2 | $L-5D_2-D_1$ | L-38.25 |

Each of the colored inks used in a printhead has different characteristics in terms of viscosity, heat profile etc. Firing pulses are therefore generated independently for each color. This are explained further below.

In addition, although coated paper may be used for printing, fixative is required for high speed printing applications on plain paper. When fixative is used it should be printed before any of the other inks are printed to that dot position. The fixative represents an OR of the data for that dot position. Printing fixative first also preconditions the paper so that the subsequent drops will spread to the right size.

A single segment contains a total of 1280C nozzles, where C is the number of colors in the segment. A print cycle involves the firing of up to all of these nozzles, dependent on the information to be printed. A load cycle involves the loading up of the segment with the information to be printed during the subsequent print cycle.

Each nozzle has an associated NozzleEnable bit that determines whether or not the nozzle will fire during the print cycle. The NozzleEnable bits (one per nozzle) are loaded via a set of shift registers.

Logically there are C shift registers per segment (one per color), each 1280 deep. As bits are shifted into the shift register for a given color they are directed to the lower and upper nozzles on alternate pulses. Internally, each 1280-deep shift register is comprised of two 640-deep shift registers: one for the upper nozzles, and one for the lower nozzles. Alternate bits are shifted into the alternate internal registers. As far as the external interface is concerned however, there is a single 1-bit by 1280 deep shift register.

Once all the shift registers have been fully loaded (1280 load pulses), all of the bits are transferred in parallel to the appropriate Nozzle Enable bits. This equates to a single parallel transfer of 1280C bits. Once the transfer has taken place, the print cycle can begin. The print cycle and the load cycle can occur simultaneously as long as the parallel load of all NozzleEnable bits occurs at the end of the print cycle.

The load cycle is concerned with loading the segment's shift registers with the next print cycle's NozzleEnable bits.

Each segment has C 1-bit inputs directly related to the C shift registers (where C is the number of colors in the segment). These inputs are named Dn, where n is 1 to C (for example, a 4 color segment would have 4 inputs labeled D1, D2, D3 and D4). A single pulse on the segment's SClk line transfers C bits into the appropriate shift registers. Alternate pulses transfer bits to the lower and upper nozzles respectively. A total of 1280 pulses are required for the complete transfer of data. Once all 1280C bits have been transferred, a single pulse on the TEn line causes the parallel transfer of data from the shift registers to the appropriate NozzleEnable bits.

The parallel transfer via a pulse on TEn must take place after the print cycle has finished. Otherwise the NozzleEnable bits for the line being printed will be incorrect.

It is important to note that the odd and even dot outputs, although printed during the same print cycle, do not appear on the same physical output line. The physical separation of odd and even nozzles within the printhead, as well as separation between nozzles of different colors ensures that they will produce dots on different lines of the page. This relative difference must be accounted for when loading the data into the printhead. The actual difference in lines depends on the characteristics of the inkjet mechanism used in the printhead. The differences can be defined by variables $D_1$ and $D_2$ where $D_1$ is the distance between nozzles of different colors, and $D_2$ is the distance between nozzles of the same color. Table 4 shows the dots transferred to a C color segment on the first 4 pulses.

TABLE 4

| | | Order of dots transferred to a segment | | | |
|---|---|---|---|---|---|
| Pulse | Dot | Color1 Line | Color2 Line | Color3 Line | ColorC Line |
| 1 | 0 | N | $N + D_1$[10] | $N + 2D_1$ | $N + (C - 1)D_1$ |
| 2 | 1 | $N + D_2$[11] | $N + D_1 + D_2$ | $N + 2D_1 + D_2$ | $N + (C - 1)D_1 + D_2$ |
| 3 | 2 | N | $N + D_1$ | $N + 2D_1$ | $N + (C - 1)D_1$ |
| 4 | 3 | $N + D_2$ | $N + D_1 + D_2$ | $N + 2D_1 + D_2$ | $N + (C - 1)D_1 + D_2$ |

[10] $D_1$ = number of lines between the nozzles of one color and the next (likely = 6–10)
[11] $D_2$ = number of lines between two rows of nozzles of the same color (likely = 2)

And so on for all 1280 pulses. For more information about line differences due to physical placement of nozzles.

Data can be clocked into a segment at a maximum rate of 80 MHz, which will load the entire 1280C bits of data in 16 $\mu$s.

A single Memjet printhead segment contains 1280 nozzles. To fire them all at once would consume too much power and has the potential for problems in terms of ink refill and nozzle interference. This problem is made more apparent when we consider that a typical Memjet printhead is composed of multiple segments, each with 1280 nozzles.

Nozzles are therefore grouped logically within a segment to enable a variety of printing speeds. These groupings allow speed/power consumption trade-offs to be made in different product configurations.

In the lowest-speed printing mode, 10 nozzles of each color are fired from the segment at a time. The exact number of nozzles fired depends on how many colors are present in the printhead. For example, in a six color (e.g. CMYK-IR-F) printing environment, 60 nozzles are fired simultaneously. To fire all the nozzles in a segment, 128 different sets of nozzles must be fired.

In the highest-speed printing mode, 80 nozzles of each color are fired from the segment at a time. The exact number of nozzles fired depends on how many colors are present in the printhead. For example, in a six color (e.g. CMYK-IR-F) printing environment, 480 nozzles are fired simultaneously. To fire all the nozzles in a segment, 16 different sets of nozzles must be fired.

The power consumption in the lowest-speed mode is one eighth that of the highest-speed mode. Note, however, that the energy consumed to print a page is the same in both cases.

Nozzles are grouped logically into pods, chromapods, phasegroups, firegroups, and finally the segment itself.

Figure 3:
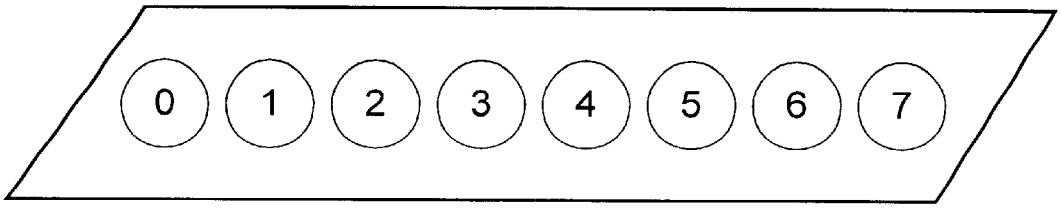
FIG. 3 illustrates a single pod and its firing order.

A single pod consists of 8 contiguous nozzles from a single physical row. Each nozzle produces dots 22.5 $\mu$m in diameter spaced on a 15.875 $\mu$m grid to print at 1600 dpi. FIG. 3 shows the arrangement of a single pod, with the nozzles numbered according to the order in which they should be fired.

Although the nozzles are fired in this order, the relationship of nozzles and physical placement of dots on the printed page is different. The nozzles within a pod are 2 dots apart, for the middle dot is printed by another row of nozzles. A single row therefore represents either the odd or even dots of a color.

Figure 4:
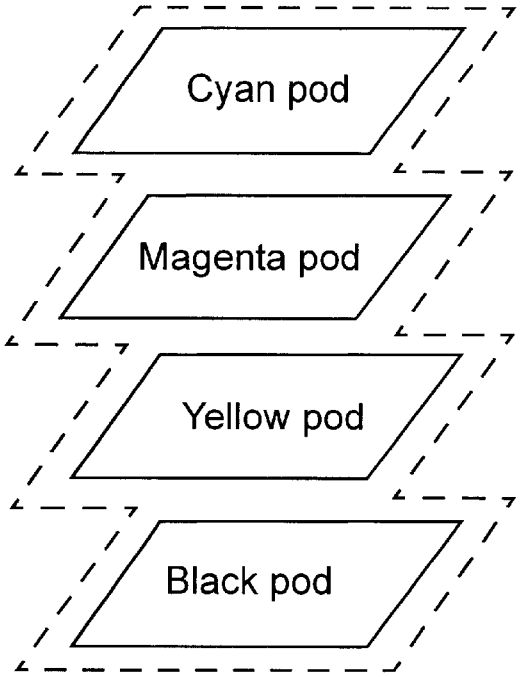
FIG. 4 illustrates a single chromapod.

One pod of each color are logically grouped together into a chromapod. The number of pods in a chromapod will depend on the particular application. In a monochrome printing system (such as one that prints only black), there is only a single color and hence a single pod. Photo printing application printheads require 3 colors (cyan, magenta, yellow), so printhead segments used for these applications will have 3 pods per chromapod (one pod of each color). A desktop printer by contrast may contain 6 pods, one for each of cyan, magenta, yellow, black, infrared and fixative. A chromapod represents different color components of the same horizontal set of 8 dots on different lines. The exact distance between different color pods depends on the printhead operating parameters, and may vary from one printhead design to another. The distance must be taken into account when printing: the dots printed by the cyan nozzles for example, will be for different lines than those printed by the magenta, yellow or black nozzles. FIG. 4 illustrates a single chromapod for a 4 color CMYK printing application.

Figure 5:
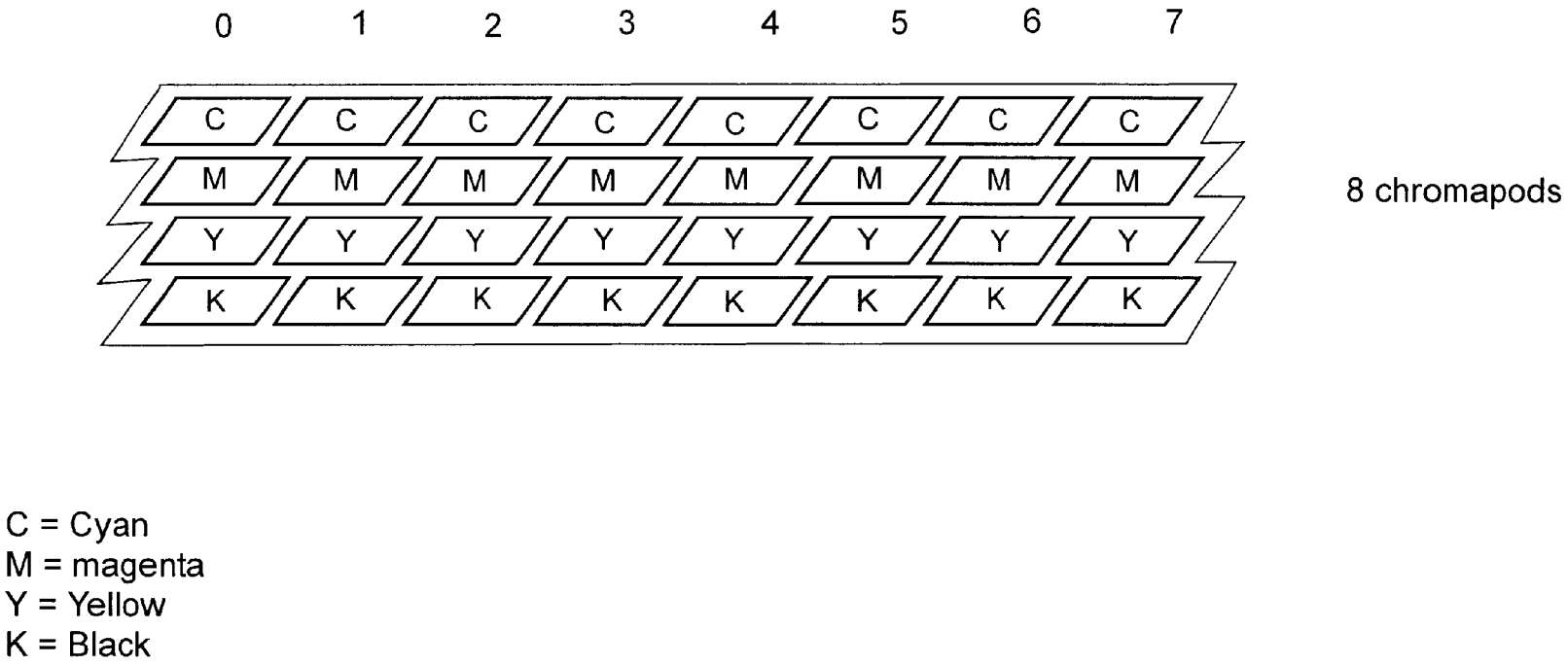
FIG. 5 illustrates a single firegroup.

8 chromapods are organized into a single firegroup. The firegroup is so named because groups of nozzles within a firegroup are fired simultaneously during a given firing phase (this is explained in more detail below). The formation of a firegroup from 8 chromapods is entirely for the purposes of multi-speed printing. During low-speed printing, only one of the eight Chromapods fires nozzles in a given firing pulse. During high-speed printing, all eight Chromapods fire nozzles. Consequently the low-speed print takes eight times as long as a high-speed print, since the high-speed print fires eight times as many nozzles at once. A firegroup therefore contains 64 nozzles for each color. The arrangement is shown in FIG. 5, with chromapods number 0–7 and using a CMYK chromapod as the example. Note that the distance between adjacent chromapods is exaggerated for clarity.

Figure 6:
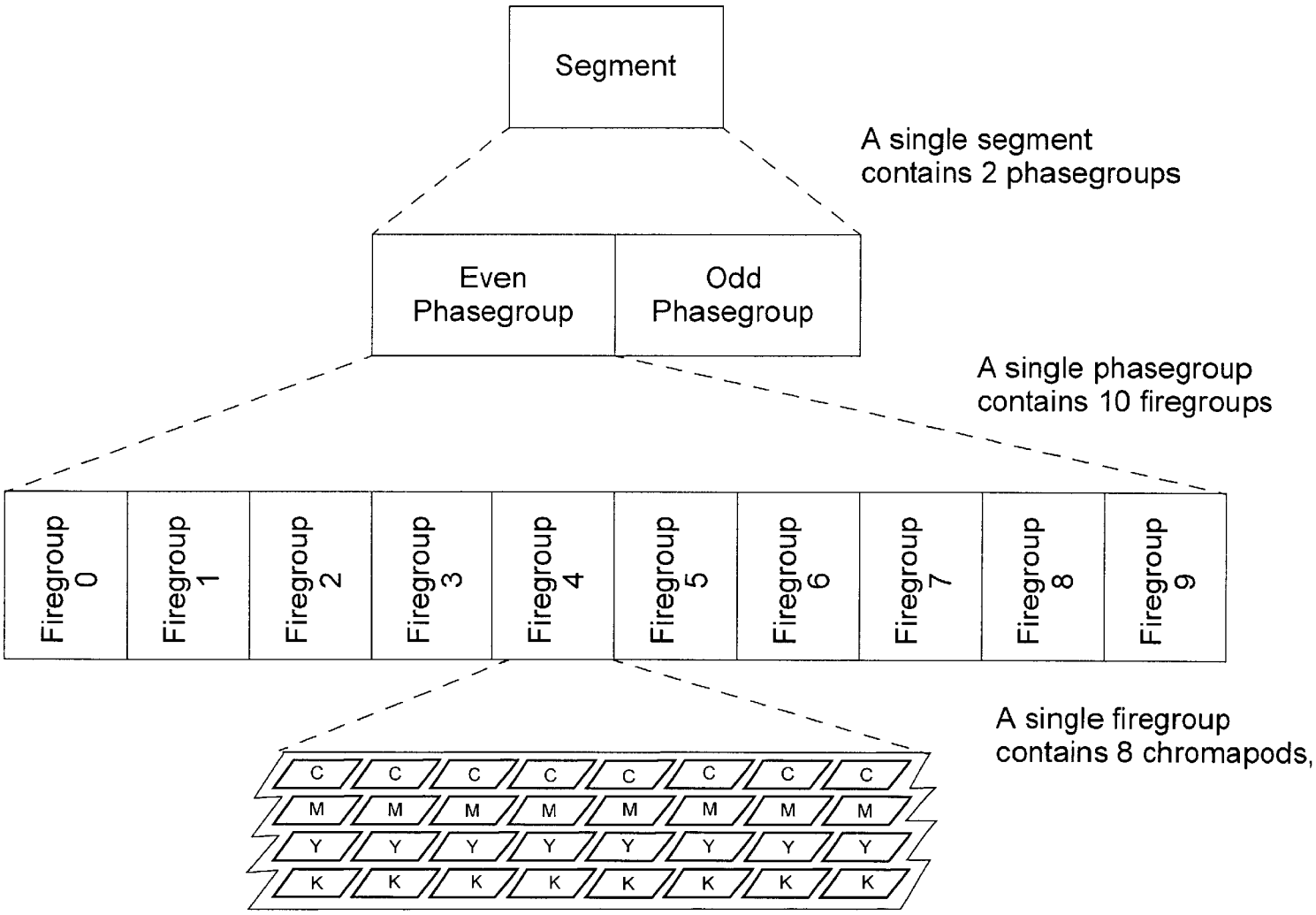
FIG. 6 shows the relationships between segments, phasegroups, firegroups and chromapods.

10 firegroups are organized into a single phasegroup, with 2 phasegroups in each segment. The Even Phasegroup contains only the even nozzle rows, while the Odd Phasegroup contains the odd nozzle rows. Two enable lines, EvenEnable and OddEnable, independently control the firing of the two phasegroups as different firing phases. Since all firegroups within a single phasegroup share the same firing pulse, the firegroups fire simultaneously. The arrangement is shown in FIG. 6. The distance between adjacent groupings is exaggerated for clarity. Table 5 is a summary of the nozzle groupings in a segment.

TABLE 5

Nozzle groupings for a single segment

| Name of Grouping | Composition | Replication Ratio | Nozzle Count |
|---|---|---|---|
| Nozzle | Base unit | 1:1 | 1 |
| Pod | Nozzles per pod | 8:1 | 8 |
| Chromapod | Pods per chromapod | C:1 | 8C |
| Firegroup | Chromapods per firegroup | 8:1 | 64C |
| Phasegroup | Firegroups per phasegroup | 10:1 | 640C |
| Segment | Phasegroups per segment | 2:1 | 1280C |

The logical nozzle groupings support a number of printing speeds, as listed in Table 6.

TABLE 6

Printing speeds supported by printhead

| Speed | # Phases | # Nozzles fired per phase |
|---|---|---|
| 1 | 128 | 10C[12] (C per firegroup) |
| 2 | 64 | 20C (2C per firegroup) |

TABLE 6-continued

Printing speeds supported by printhead

| Speed | # Phases | # Nozzles fired per phase |
|---|---|---|
| 3 | 32 | 40C (4C per firegroup) |
| 4 | 16 | 80C (8C per firegroup) |

[12]C = number of colors

The print speed is programmed into the Memjet printhead by means of the serial interface. The interpretation of the print speed relies on an understanding of the printhead internals, which are therefore described here.

The nozzles to be fired in a given firing pulse are determined by:

3 bits NozzleSelect (select 1 of 8 nozzles from a pod)

8 bits of ChromapodSelect (select 0–8 chromapods to fire)

When one of the ChromapodSelect bits is set, only the specified chromapod's nozzles will fire as determined by ChromapodSelect and NozzleSelect. When all eight of the ChromapodSelect lines are set, all of the chromapods will fire their nozzles. When told to start printing a line via a pulse on the NPSync line, the state machine inside the printhead simply runs through NozzleSelect from 0 to 7 for each valid set of ChromapodSelect values. To run through the valid set of ChromapodSelect values, ChromapodSelect is shifted a specified number of bits. When the ChromapodSelect matches the initial ChromapodSelect, the NozzleSelect value is incremented. This helps to spread the power and heat evenly across the printhead during the printing of a line. Table 7 lists various print speeds together with the related settings for ChromapodSelect and bit shift amount.

TABLE 7

Initial settings for ChromapodSelect

| Speed | ChromapodSelect | shift |
|---|---|---|
| 1 | 10000000 | 1 |
| 2 | 11000000 | 2 |
| 3 | 11110000 | 4 |
| 4 | 11111111 | 0(8) |

For the high-speed printing mode, the state machine generates the firing order over 16 phases as listed in Table 8.

TABLE 8

High speed printing firing order

| Chromapod Select | Nozzle Select | Phases |
|---|---|---|
| 11111111 | 0 | Even & Odd |
| 11111111 | 1 | Even & Odd |
| 11111111 | 2 | Even & Odd |
| 11111111 | 3 | Even & Odd |
| 11111111 | 4 | Even & Odd |
| 11111111 | 5 | Even & Odd |
| 11111111 | 6 | Even & Odd |
| 11111111 | 7 | Even & Odd |

The firing order is similar for slower printing modes. However, instead of setting all the bits of ChromapodSelect, we simply set 1, 2 or 4 of those bits. The fewer bits that are set the few nozzles will fire. When only 1 bit of ChromapodSelect is set, it takes 8 times as long as the high speed mode to fire all nozzles. The firing order for the slowest speed printing is shown in Table 9.

TABLE 9

Low speed printing firing order

| Chromapod Select | Nozzle Select | Phases |
|---|---|---|
| 10000000 | 0 | Even & Odd |
| 01000000 | 0 | Even & Odd |
| 00100000 | 0 | Even & Odd |
| 00010000 | 0 | Even & Odd |
| 00001000 | 0 | Even & Odd |
| 00000100 | 0 | Even & Odd |
| 00000010 | 0 | Even & Odd |
| 00000001 | 0 | Even & Odd |
| 10000000 | 1 | Even & Odd |
| 01000000 | 1 | Even & Odd |
| | . . . etc . . . | |
| 00000010 | 7 | Even & Odd |
| 00000001 | 7 | Even & Odd |

The EvenEnable and OddEnable are separate generated signals for each color in order that the firing pulses can overlap. Thus the 128 phases of a low-speed print cycle consist of 64 Even phases and 64 Odd phases. Likewise, the 16 phases of a high-speed print cycle consist of 8 Even phases and 8 Odd phases.

Figure 7:
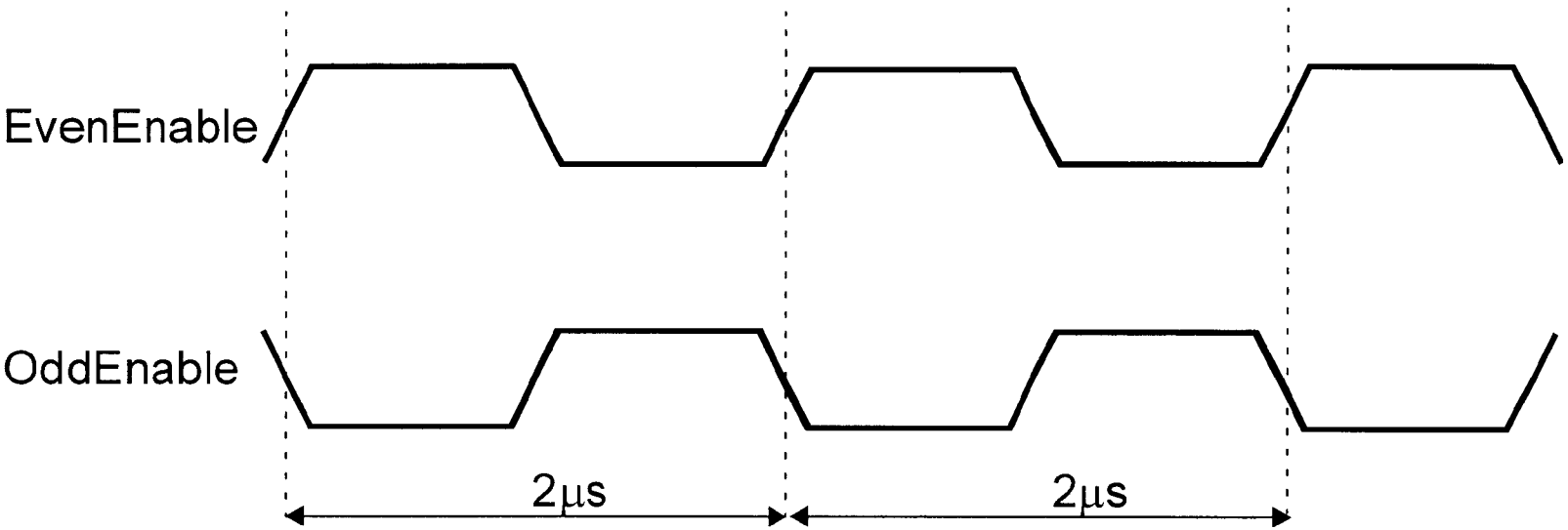
FIG. 7 illustrates the enabling pulses for nozzle firing.

There are consequently 2 separate timing generators for each color. Each timing generator uses its own programmable 200-bit entry pulse profile. The 200 1-bit entries define a total of 2 $\mu$s where each entry defines a 10 ns time interval. Since the typical duration of a firing pulse is 1.3–1.8 $\mu$s a 2 $\mu$s duration is adequate. Two 200-bit tables are therefore required for each color present on the printhead. The tables are programmed via the printhead's serial interface. It is quite reasonable for the odd and even pulse profiles to be the same, but they will typically be offset from each other by 1 $\mu$s to take account of the fact that the pulses overlap. FIG. 7 shows example EvenEnable and OddEnable lines for a single color during a typical print cycle where the pulse is very simple.

The pulse profile for a given color depends on the viscosity of the ink (dependent on temperature and ink characteristics) and the amount of power available to the printhead. The viscosity curve of the ink can be obtained from the ink supply's QA chip. The line times then for the various print speeds are twice as fast as would first appear, since the two phases are overlapping. The print speeds are therefore as listed in Table 10.

TABLE 10

Line times for various print speeds

| Speed | # Phases | Line Time | # lines per second |
|---|---|---|---|
| 1 | 128 | 128 $\mu$s | 7812 |
| 2 | 64 | 64 $\mu$s | 15,625 |
| 2 | 32 | 32 $\mu$s | 31,250 |
| | 16 | 16 $\mu$s | 62,500 |

The firing of a nozzle also causes acoustic perturbations for a limited time within the ink reservoir of that nozzle. The perturbations can interfere with the firing of that nozzle for the next line. The shortest time between a single nozzles firing is 32 $\mu$s (the fastest print speed). As the ink channel is 300 $\mu$m long and the velocity of sound in the ink is around 1500 m/s, the resonant frequency of the ink channel is 2.5 MHz. The high-speed mode allows 80 resonant cycles, which gives minimal acoustic interference.

A segment produces several types of feedback, all of which can be used to adjust the timing of the firing pulses. Since multiple segments are collected together into a printhead, it is effective to share the feedback line as a tri-state bus, with only one of the segments placing the feedback information on the feedback line.

A pulse on the segment's CCEn line ANDed with data on D1 selects if the particular segment will provide the feedback. The feedback sense line will come from that segment until the next CCEn pulse. The feedback is one of:

Tsense informs the controller how hot the printhead is. This allows the controller to adjust firing pulse profiles, since temperature affects the viscosity of the ink.

Vsense informs the controller how much voltage is available to the actuator. This allows the controller to compensate for a flat battery or high voltage source by adjusting the pulse width.

Rsense informs the controller of the resistivity (Ohms per square) of the actuator heater. This allows the controller to adjust the pulse widths to maintain a constant energy irrespective of the heater resistivity.

Wsense informs the controller of the width of the critical part of the heater, which may vary up to ±5% due to lithographic and etching variations. This allows the controller to adjust the pulse width appropriately.

The printing process has a strong tendency to stay at the equilibrium temperature. To ensure that the first section of the printed page has a consistent dot size, the equilibrium temperature must be met before printing any dots. This is accomplished via a preheat cycle. The preheat cycle involves a single load cycle to all nozzles of a segment with 1 s (i.e. setting all nozzles to fire), and a number of short firing pulses to each nozzle. The duration of the pulse must be insufficient to fire the drops, but enough to heat up the ink. Altogether about 200 pulses for each nozzle are required, cycling through in the same sequence as a standard print cycle. Feedback during the preheat mode is provided by Tsense, and continues until equilibrium temperature is reached (about 30° C. above ambient). The duration of the preheat mode is around 50 milliseconds, and depends on the ink composition. Preheat is performed before each print job. This does not affect performance as it is done while the data is being transferred to the printer.

In order to reduce the chances of nozzles becoming clogged, a cleaning cycle can be undertaken before each print job. Each nozzle is fired a number of times into an absorbent sponge. The cleaning cycle involves a single load cycle to all nozzles of a segment with 1 s (i.e. setting all nozzles to fire), and a number of firing pulses to each nozzle. The nozzles are cleaned via the same nozzle firing sequence as a standard print cycle. The number of times that each nozzle is fired depends upon the ink composition and the time that the printer has been idle. As with preheat, the cleaning cycle has no effect on printer performance.

The printhead segment is programmed via an $I^2C$ serial interface. This includes setting the following parameters:

2 sets of 200-bit pulse profiles for each color

Print speed

Feedback data type (temperature, resistivity etc.)

In addition, the combined printhead's characterization vector is read back via the serial interface. The characterization vector includes dead nozzle information as well as relative segment alignment data. Each printhead segment can be queried via its low speed serial bus to return a characterization vector of the segment. The characterization vectors from multiple printheads can be combined to construct a nozzle defect list for the entire printhead and allows the print engine to compensate for defective nozzles during the print. As long as the number of defective nozzles is low, the compensation can produce results indistinguishable from those of a printhead with no defective nozzles.

Each segment has 384 bits for characterization vector, comprised of:

- 64 bits of flags and printhead segment information, including serial number and number of colors represented in the segment
- 16 bits of alignment data relative to previous segment (0=first segment)
- a variable lengthed defective nozzle list using up the remaining bits The defective nozzle list is variable lengthed, with each set of defective nozzles having the following structure:

- 5 bits count (0=end-of-list)
- 3 bits of color
- count×11 bits, one entry per defective nozzle In general terms a printhead segment has connections as defined in Table 11. Note that some of the connections are replicated when multiple colors present.

TABLE 11

Printhead segment connections

| Name | Repeat for multi-colored segment | Function |
|---|---|---|
| D[n] | Yes | Channel n of image data |
| SClk | No | Serial data transfer clock |
| NPSync | No | Nozzle Phase Synchronization |
| PLL | No | Phase Locked Loop clock |
| TEn | No | Parallel transfer enable |
| Reset | No | Control Reset |
| SCl | No | $I^2C$ serial clock for control |
| SD | No | $I^2C$ serial data for control |
| CCEn[n] | No | Control Chip Enable [n] |
| Gnd | No | Analog ground |
| Sense | No | Analog sense output |
| V− | Yes | Negative actuator supply |
| V+ | Yes | Positive actuator supply |
| $V_{ss}$ | Yes | Negative logic supply |
| $V_{dd}$ | Yes | Positive logic supply |

The 21 mm long printhead segment has 64 bond pads, on 300 $\mu$m centers, 24 of these bond pads are V− power supply to the actuators, and 20 are V+ power supply to the actuators. The remaining 20 connections are CMOS logic power, signal, and data connections. Table 12 details these connections.

TABLE 12

6 color segment connections

| # | Name | Function |
|---|---|---|
| 1–6 | V− | Negative actuator supply |
| 7 | $V_{ss}$ | Negative logic supply |
| 8 | D1[n] | Channel 1 of image data [n] (fixative in 6 channel printhead) |
| 9 | D2[n] | Channel 2 of image data [n] (infrared in 6 channel printhead) |
| 10 | SClk | Serial data transfer clock |
| 11 | $V_{dd}$ | Positive logic supply |
| 12–16 | V+ | Positive actuator supply |
| 17–22 | V− | Negative actuator supply |
| 23 | NPSync | Nozzle Phase Synchronization |

TABLE 12-continued 6 color segment connections

| # | Name | Function |
|---|---|---|
| 24 | D3[n] | Channel 3 of image data [n] (black in 6 channel printhead) |
| 25 | D4[n] | Channel 4 of image data [n] (yellow in 6 channel printhead) |
| 26 | PLL | Phase Locked Loop clock |
| 27 | TEn | Parallel transfer enable |
| 28–32 | V+ | Positive actuator supply |
| 33–38 | V− | Negative actuator supply |
| 39 | Reset | Control Reset |
| 40 | D5[n] | Channel 5 of image data [n] (magenta in 6 channel printhead) |
| 41 | D6[n] | Channel 6 of image data [n] (cyan in 6 channel printhead) |
| 42 | SCl | $I^2C$ serial clock for control |
| 43 | SD | $I^2C$ serial data for control |
| 44–48 | V+ | Positive actuator supply |
| 49–54 | V− | Negative actuator supply |
| 55 | $V_{dd}$ | Positive logic supply |
| 56 | Gnd | Analog ground |
| 57 | CCEn[n] | Control Chip Enable [n] |
| 58 | $V_{ss}$ | Negative logic supply |
| 59 | Sense | Analog sense output |
| 60–64 | V+ | Positive actuator supply |

A multi-segment printhead is ideally composed of a number of identical printhead segments. These are typically 21 mm segments that are manufactured together, or placed together after manufacture, to produce a printhead of the desired length. The segments may be set with overlap, as desired, to allow for smooth transitions between segments. Each 21 mm inch segments prints 1600 dpi bi-level dots over a different part of the page to produce the final image. Although each segment produces 1280 dots of the final image, each dot is represented by a combination of colored inks. For example, 15 segments can be combined side-by-side to produce a 12-inch printhead. Each segment can be considered to have a lead-in area, a central area, and a lead-out area. The lead-out of one segment corresponds to the lead-in of the next.

Figure 8:
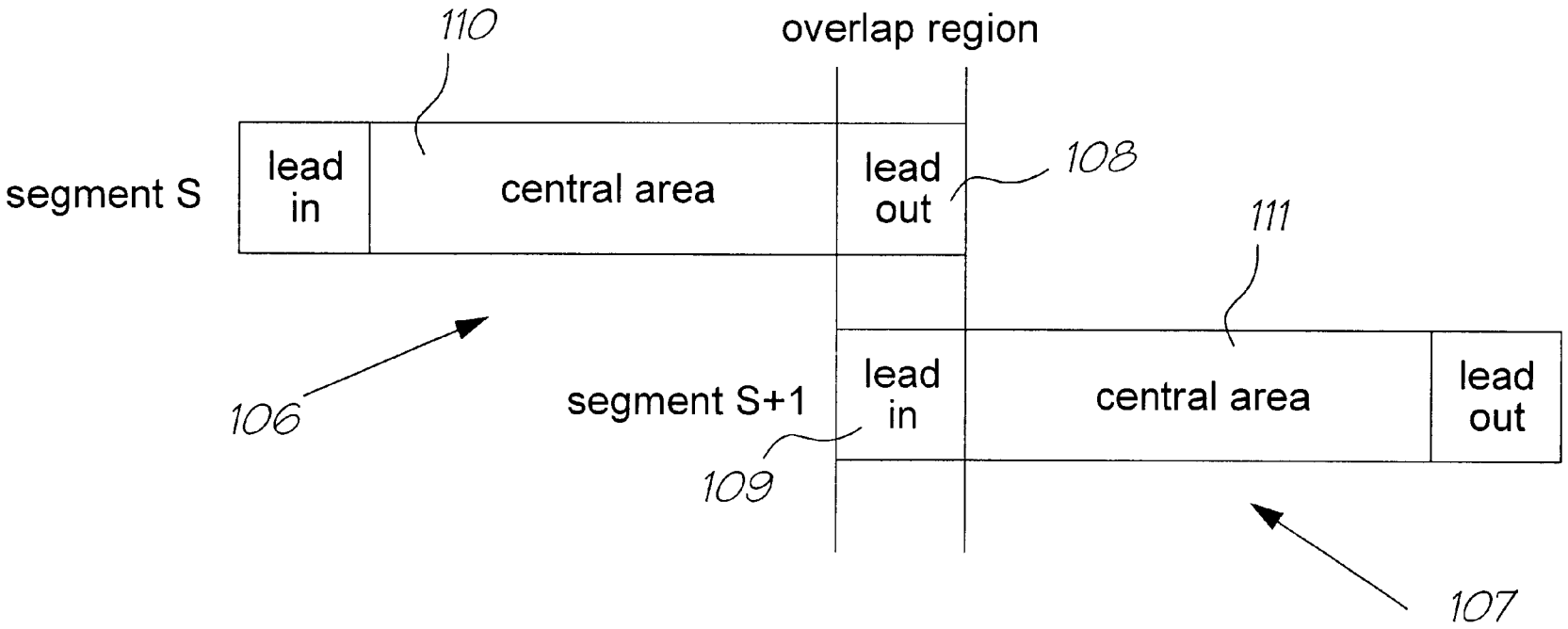
FIG. 8 shows the manner of overlap of segments in a multi-segment printhead.

In FIG. 8 is seen the three areas of a segment by showing two overlapping segments 106, 107. Note that the lead-out area 108 of segment S (110) corresponds to the lead-in area 109 of segment S+1 (107). The central area of a segment is that area that has no overlap at all (110 of 106 and 111 of 107). Although the figure shows the segments vertically staggered, the segments are staggered at a slight angle so that they are aligned in the vertical dimension.

A number of considerations must be made when wiring up a printhead. As the width of the printhead increases, the number of segments increases, and the number of connections also increases. Each segment has its own Dn connections (C of them), as well as SClk and other connections for loading and printing.

When the number of segments S is small it is reasonable to load all the segments simultaneously by using a common SClk line and placing C bits of data on each of the Dn inputs for the segments. In a 4-segment 4 color printer, the total number of bits to transfer to the printhead in a single SClk pulse is 16. However for a six channel enabled (C=6) 12-inch printer, S=15, and it is unlikely to be reasonable to have 90 data lines running from the print data generator to the printhead. Instead, it is convenient to group a number of segments together for loading purposes. Each group of segments is small enough to be loaded simultaneously, and share an SClk. For example, a 12-inch printhead can have 2 segment groups, each segment group containing 8 segments.

48 Dn lines can be shared for both groups, with 2 SClk lines, one per segment group. Even though there is no segment for the 2nd set of 8 segments, it is still convenient to group the segments. Some bits will therefore be unused in the last group.

As the number of segment groups increases, the time taken to load the printhead increases. When there is only one group, 1280 load pulses are required (each pulse transfers C data bits). When there are G groups, 1280G load pulses are required. The bandwidth of the connection between the data generator and the printhead must be able to cope and be within the allowable timing parameters for the particular application. If G is the number of segment groups, and L is the largest number of segments in a group, the printhead requires LC ColorData lines and G SClk lines. Regardless of G, only a single TEn line is required—it can be shared across all segments. Since L segments in each segment group are loaded with a single SClk pulse, any printing process must produce the data in the correct sequence for the printhead. As an example, when G=2 and L=4, the first SClk1 pulse will transfer the Dn bits for the next Print Cycle's dot 0, 1280, 2560 and 3840. The first SClk2 pulse will transfer the Dn bits for the next Print Cycle's dot 5120, 6400, 7680, and 8960. The second SClk1 pulse will transfer the Dn bits for the next Print Cycle's dot 1, 1281, 2561, and 3841. The second SClk2 pulse will transfer the Dn bits for the next Print Cycle's dot 5121, 6401, 7681 and 8961. After 1280G SClk pulses (1280 to each of SClk1 and SClk2), the entire line has been loaded into the printhead, and the common TEn pulse can be given.

It is important to note that the odd and even color outputs, although printed during the same print cycle, do not appear on the same physical output line. The physical separation of odd and even nozzles within the printhead, as well as separation between nozzles of different colors ensures that they will produce dots on different lines of the page. This relative difference must be accounted for when loading the data into the printhead. Considering only a single segment group, Table 13 shows the dots transferred to segment n of a printhead during the first 4 pulses of the shared SClk.

TABLE 13

Order of dots transferred to segment S in a multi-segment printhead

| Pulse | Dot | Color1 Line | Color2 Line | ColorC Line |
|---|---|---|---|---|
| 1 | 1280S[13] | N | $N + D_1$[14] | $N + (C - 1)D_1$ |
| 2 | 1280S + 1 | $N + D_2$[15] | $N + D_1 + D_2$ | $N + (C - 1)D_1 + D_2$ |
| 3 | 1280S + 2 | N | $N + D_1$ | $N + (C - 1)D_1$ |
| 4 | 1280S + 3 | $N + D_2$ | $N + D_1 + D_2$ | $N + (C - 1)D_1 + D_2$ |

[13]S = segment number
[14]$D_1$ = number of lines between the nozzles of one color and the next (likely = 7–10)
[15]$D_2$ = number of lines between two rows of nozzles of the same color (likely = 2)

And so on for all 1280 SClk pulses to the particular segment group.

With regards to printing, 10C nozzles are printed from each segment in the lowest speed printing mode, and 80C nozzles from each segment in the highest speed printing mode.

While it is certainly possible to wire up segments in any way, this specification only considers the situation where all segments fire simultaneously. This is because the low-speed printing mode allows low-power printing for small printheads (e.g. 2-inch and 4-inch), and the controller chip design assumes there is sufficient power available for the large print sizes (such as 8–18 inches). It is a simple matter to alter the connections in the printhead to allow grouping of firing should a particular application require it. When all segments are fired at the same time 10C nozzles are fired in the low-speed printing mode and 80CS nozzles are fired in the high-speed printing mode. Since all segments print simultaneously, the printing logic is the same as defined above and the line times are the same as defined by Table 10.

A segment produces an analog line of feedback, as defined above. The feedback is used to adjust the profile of the firing pulses. Since multiple segments are collected together into a printhead, it is effective to share the feedback lines as a tri-state bus, with only one of the segments placing the feedback information on the feedback lines at a time. Since the selection of which segment will place the feedback information on the shared sense line relies on D1, the groupings of segments for loading data can be effectively used for selecting the segment for feedback. Just as there are G SClk lines (a single line is shared between segments of the same segment group), there are G CCEn lines shared in the same way. When the correct CCEn line is pulsed, the segment of that group whose D1 bit is set will start to place data on the shared feedback lines. The segment previously active in terms of feedback must also be disabled by having a 0 on its D1 bit, and this segment may be in a different segment group. Therefore when there is more than one segment group, changing the feedback segment requires two steps: disabling the old segment, and enabling the new segment.

It is assumed below that a printhead has been constructed from a number of segments as described above. It is assumed that for data loading purposes, the segments have been grouped into G segment groups, with L segments in the largest segment group. It is assumed there are C colors in the printhead. It is assumed that the firing mechanism for the printhead is that all segments fire simultaneously, and only one segment at a time places feedback information on a common tri-state bus. Assuming all these things, Table 14 lists the external connections that are available from a printhead:

TABLE 14

Printhead connections

| Name | #Pins | Description |
|---|---|---|
| Dn | CL | Inputs to C shift registers of segments 0 to L-1 |
| SClk | G | A pulse on SClk[N] (ShiftRegisterClock N) loads the current values from Dn lines into the L segments in segment group N. |

TABLE 14-continued

Printhead connections

| Name | #Pins | Description |
|---|---|---|
| NPSync | 1 | A pulse on NPSync starts the printing of a line for all segments. |
| PLL | 1 | Phase Locked Loop clock for generation of timing signals in printhead |
| Ten | 1 | Parallel transfer of data from the shift registers to the internal NozzleEnable bits (one per nozzle). |
| Reset | 1 | Control reset |
| SCl | 1 | $I^2C$ serial clock for control |
| SD | 1 | $I^2C$ serial data for control |
| CCEn | G | A pulse on CCEn N ANDed with data on D1[n] selects the sense lines for segment n in segment group N. |
| Sense | 1 | Analog sense output |
| Gnd | 1 | Analog sense ground |
| V− | Many, depending on the number of colors | Negative actuator supply |
| V+ | | Positive actuator supply |
| $V_{ss}$ | | Negative logic supply |
| $V_{dd}$ | | Positive logic supply |

Throughout the specification the aim has been to describe the preferred embodiments of the invention without limiting the invention to any one embodiment or specific collection of features. Persons skilled in the art may realize variations from the specific embodiments that will nonetheless fall within the scope of the invention.

What is claimed is:

1. A method of controlling the firing of nozzles on rows for respective ink channels in a printhead the method including:

loading print data to respective channel shift registers on respective segments to the printhead;

transferring print data to nozzle enable bits provided one per nozzle; and firing the nozzles in respective channels in time independent manner using separate timing generators in each channel wherein nozzles in respective channels are similarly grouped and the nozzles within groups are fired successively;

such that respective rows of nozzles are organized in repeated pods of nozzles along the length of each row of nozzles, the nozzles in a pod being fired one after the other along the row;

successive pods of respective channels are linked as a chromapod wherein the one after the other firing of nozzles in each channel is in step along the row of nozzles in the respective pods; and blocks of chromapods are operated as a firegroup, the firegroups firing together.

2. A method of controlling the firing of nozzles in a printhead as claimed in claim 1 wherein a channel's firing can be started at a set time allowing printing at a chosen delay for off-dot-line and dot-on-dot printing.

3. A method of controlling the firing of nozzles in a printhead as claimed in claim 1 wherein the nozzles are fired by a train of electrical pulses and the profiles of the pulses are programmed to suite the ink at the nozzles.

4. A method of controlling the firing of nozzles in a printhead as claimed in claim 3 wherein each pulse profile is adjusted by programmed bits loaded to a timing generator, the programmed bits being loaded to the printhead from tables one for each channel, via the printhead serial interface.

5. A method of controlling the firing of nozzles in a printhead as claimed in any one of claims 3 or 4 wherein the printhead nozzle rows are in offset pairs for each channel and firing of the offset pairs is effected by out of phase pulse trains.

6. A method of controlling the firing of nozzles in a printhead as claimed in claim 1 wherein the firing of the printheads is controlled by setting the firing pattern of the chromapods within their firegroups.

7. A method of controlling the firing of nozzles in a printhead as claimed in claim 1 wherein the printhead nozzle rows are in offset pairs for each channel and blocks of firegroups form phasegroups there being two phasegroups driving each segment of a segmented printhead, one phase group for each of the two offset nozzle rows.

8. A printhead including nozzle rows, successive rows of nozzles defining respective ink channels including:

respective channel shift registers in which to receive print data;

nozzle enable bits provided one per nozzle at which to receive the print data from respective channel shift registers; and separate timing generators in each channel to effect nozzle firing in respective channels in time independent manner wherein the nozzles in respective channels are similarly grouped and groups are fired successively such that respective rows of nozzles are organized in repeated pods of nozzles along the length of each row of nozzles, the nozzles in a pod being fired one after the other along the row;

successive pods of respective channels are linked as a chromapod wherein the one after the other firing of nozzles in each channel is in step along the row of nozzles in the respective pods; and firing of the nozzles is controlled by setting the firing pattern of the chromapods.

9. A printhead as claimed in claim 8 wherein the nozzles are fired by an electrical pulse train, the profile of the pulses being programmable.

10. A printhead as claimed in claim 9 wherein the pulse profile is determined by programmed bits loaded to a timing generator.

11. A printhead as claimed in claim 10 wherein the programmed bits exist in tables loaded to the printhead, one for each channel.

12. A printhead as claimed in claim 11 wherein the tables are programmed via a serial interface to the printhead.

13. A printhead as claimed in any one of claims 9 to 12 wherein the printhead nozzle rows are in offset pairs for each channel and firing of the offset pairs is by out of phase pulse trains.

14. A printhead as claimed in any one of claims 10 to 12 including an interface to the print head by which the timing parameters can be specified externally operated via a slow serial interface.

15. A printhead as claimed in claim 8 wherein each channel is formed by two offset rows of nozzles and chromapods are organized in blocks as firegroups whose chromapods fire simultaneously to form two phasegroups each driving all of the nozzles of one of the offset rows of a segment of a segmented printhead.

16. A printer having a printhead including nozzle rows, successive rows of nozzles defining respective ink channels including:

respective channel shift registers in which to receive print data;

nozzle enable bits provided one per nozzle at which to receive the print data from respective channel shift registers; and separate timing generators in each channel to effect nozzle firing in respective channels in time independent manner wherein respective rows of nozzles are organized in repeated pods of nozzles along the length of each row of nozzles, the nozzles in a pod being fired one after the other along the row;

successive pods of respective channels are linked as a chromapod wherein the one after the other firing of nozzles in each channel is in step along the rows of nozzles in the respective pods; and firing of the nozzles is controlled by setting the firing pattern of the chromapods.

17. A printer as claimed in claim 16 wherein the nozzles are fired by an electrical pulse train, the profile of the pulses being programmable and determined by programmed bits loaded to a timing generator.

18. A printer as claimed in claim 17 wherein the programmed bits exist in tables loaded to the printhead, one for each channel via an interface to the printhead.

* * * * *

UNITED STATES PATENT AND TRADEMARK OFFICE

CERTIFICATE OF CORRECTION

PATENT NO. : 6,398,332 B1 
DATED : June 4, 2002
INVENTOR(S) : Kia Silverbrook and Simon Robert Walmsley It is certified that error appears in the above-identified patent and that said Letters Patent is hereby corrected as shown below:

Column 16,
Lines 30-33, should read:
6. A method of controlling the firing of nozzles in a printhead as claimed in claim 1 wherein the firing of the nozzles is controlled by setting the firing pattern of the chromapods within their firegroups.

Signed and Sealed this

Twenty-ninth Day of October, 2002

*Attest:*

*Attesting Officer*

JAMES E. ROGAN
*Director of the United States Patent and Trademark Office*